US007381914B1

(12) United States Patent
Plesko et al.

(10) Patent No.: US 7,381,914 B1
(45) Date of Patent: Jun. 3, 2008

(54) BUTTON ACTUATION ASSEMBLY

(75) Inventors: George A. Plesko, Newtown Square, PA (US); Yuan-Hua Wang, Jiangsu (CN)

(73) Assignee: Metrologic Instruments, Inc., Blackwood, NJ (US)

( * ) Notice: Subject to any disclaimer, the term of this patent is extended or adjusted under 35 U.S.C. 154(b) by 0 days.

(21) Appl. No.: 11/560,381

(22) Filed: Nov. 16, 2006

(51) Int. Cl.
*H01H 9/26* (2006.01)

(52) U.S. Cl. ..... 200/5 A; 200/341

(58) Field of Classification Search ..... 200/5 A, 200/5 R, 314, 341–345, 520
See application file for complete search history.

(56) References Cited

U.S. PATENT DOCUMENTS 6,002,093 A 12/1999 Hrehor, Jr. et al.
2003/0080007 A1* 5/2003 Lau ..... 206/308.2
2004/0182685 A1* 9/2004 Tsunemoto ..... 200/5 R
2005/0099393 A1 5/2005 Johnson
2005/0145473 A1* 7/2005 Ni ..... 200/563
2006/0273784 A1* 12/2006 Godoy et al. ..... 324/207.2

* cited by examiner

*Primary Examiner*—Michael A. Friedhofer
*Assistant Examiner*—Lisa Klaus
(74) *Attorney, Agent, or Firm*—Duane Morris, LLP

(57) ABSTRACT

An improved button actuation assembly for activating a switch on hand held devices such as portable barcode readers has an improved structure that absorbs and dissipates the force exerted on the button. The improved structure thus protects the switch and the button actuation assembly itself from being damaged by excessive force such as from an impact shock caused by dropping or misuse.

2 Claims, 9 Drawing Sheets

BUTTON ACTUATION ASSEMBLY

FIELD OF THE INVENTION

The present invention relates to an improved button actuation assembly for activating a switch.

BACKGROUND

Many hand held devices, such as point-of-sale barcode readers, have one or more button actuators for activating one or more functions of the device. For example, in a hand held point-of-sale barcode readers, a button actuator is provided for activating a switch for the laser beam that scans barcodes. These button actuators or actuation assemblies may come in a variety of mechanical configurations and generally have a button that the user presses to activate the laser scan function. Although it is possible that the button is an integral part of the electrical switch that electrically activates the laser beam scanner, more often, for aesthetical reasons, the button may be a separate structure that is directly or indirectly linked to the switch inside the hand held device. Often, the button is shaped to aesthetically blend in with the shape and appearance of the hand held device. The button is merely a mechanical linkage that transfers the force exerted on the button directly to the switch inside the hand held device.

Because of the nature of its application, hand held point-of-sale barcode readers generally are subject to impact shocks from being dropped or intentionally being banged against a hard surface by the users. By virtue of their function and portability, hand held barcode readers are used at locations such as point-of-sale cash registers, warehouses and hospital floors. Hence, they can easily be dropped onto hard surfaces such as counter tops or concrete floors. Sometimes, cashiers may hit the hand held barcode readers against hard surfaces like the checkout counter top when they believe that the barcode reader is not working properly because a barcode is not read immediately.

In many conventional hand held barcode reader devices, the button actuators do not provide sufficient shock absorption and the impact shock from being dropped or banged against something hard will often break the external button activator mechanism or break the electrical switch inside the devices. Such destructive shock is transmitted through the button actuator mechanism to the switch. Thus, there is a need for a robust and durable button actuator assembly that can withstand the impact shock of dropping or abuse of the hand held device.

SUMMARY

According to an embodiment, a button actuation assembly for activating a switch is disclosed. The button actuation assembly includes a button having an interior side and an exterior side. A flexible cantilever is provided on the interior side of the button for engaging the switch. When a user presses the button by exerting a force on the exterior side of the button, the flexible cantilever transfers the force to the switch and activates the switch. However, because the flexible cantilever bends, it does not transfer the force directly but attenuates and limits the force. This limiting function of the flexible cantilever protects the switch from being damaged when excessive force is applied to the button.

A button retainer holds the button, at rest, in a fixed position with respect to the switch so that when the button is pressed, it actuates the switch in a repeatable and consistent manner. A button buffer made of a compressible material is provided between the button and the button retainer. The button buffer functions as a shock absorber between the button and the button retainer to diffuse and absorb a portion of any force exerted on the button. The button buffer also functions to limit the travel of the button when pressed. This is particularly beneficial to protect the assembly from damage when an excessive force is applied to the button. A bias spring is also provided between the button retainer and the button for biasing the button away from the switch.

According to another embodiment, a hand held device that incorporates the button actuation assembly for activating a switch is disclosed. Such a device includes a switch provided within the housing of the device for activating a function of the device. A button having a flexible cantilever is provided within the housing of the device and engages the switch via the flexible cantilever. When a user presses the button, exerting a force on the button, the flexible cantilever transfers and limits the force to the switch during activation of the switch. A button retainer holds the button, at rest, in a fixed position with respect to the switch within the housing. A button buffer made of a compressible material provided between the button and the button retainer absorbs impact shock and spreads force evenly to the button retainer. A bias spring may be provided between the button retainer and the button to assist in returning the button to the non-activated state after it has been pressed.

The combination of the flexible cantilever on the button and the button buffer substantially reduces the damage from impact shock to the switch and the button itself. Furthermore, the elasticity and compliance of the button buffer provides a softer high quality feel to the button when the user pushes the button.

In one embodiment, the housing includes a window opening through which the button is exposed and allows the user to press the button. The degree to which the button protrudes through the opening is an aesthetic design consideration. Alternatively, the window can be covered with a thin flexible membrane through which the button can be pressed. Such membrane can either be adhesively and/or mechanically attached to the housing or molded integrally with the housing of the hand held device. The flexible membrane will prevent unwanted contaminants such as water or dust from entering the handheld device and damaging its internal components.

The button retainer is attached to the device's housing and holds the button between the button retainer and the housing. The housing maybe a two-piece housing comprising an upper piece and a lower piece with the button retainer attached to the upper piece to hold the button between the button retainer and the upper piece of the housing. Alternatively, the button retainer can be attached to the lower piece of the housing to hold the button between the button retainer and the lower piece of the housing.

The switch is generally provided on a printed circuit board inside the housing of the hand held device. In a further variation of the embodiment, the complete button actuation assembly is attached to the printed circuit board. In other words, the button retainer holds the button buffer and the button within the button retainer and the button retainer is affixed to the printed circuit board so that the button engages the switch and is held in a fixed position relative to the switch.

According to another embodiment of the invention, the hand held device is a point-of-sale barcode reading device. Inside the housing of the hand held point-of-sale barcode reader, is provided a laser source that produces the laser beam and a scan mechanism for scanning the beam. In this embodiment, when the button is pressed, the switch activates the laser scanning function.

The various embodiments of the invention will be described with the aid of the following drawings, in which, like reference numbers represent like elements.

DETAILED DESCRIPTION OF THE INVENTION

Figure 1:
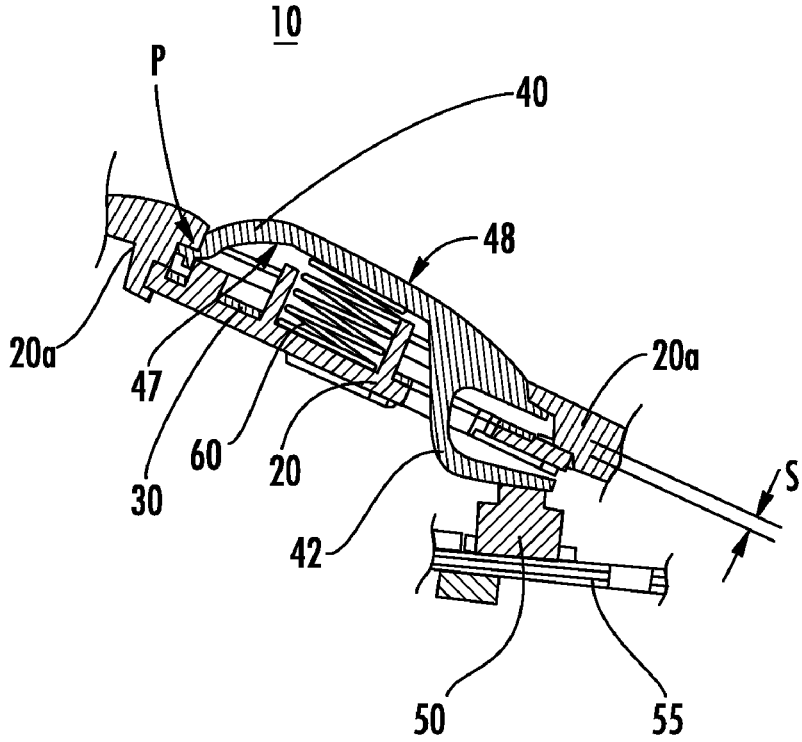
FIG. 1 is a schematic illustration of a cross-sectional view of a button actuation assembly according to an embodiment of the invention.
Figure 2:
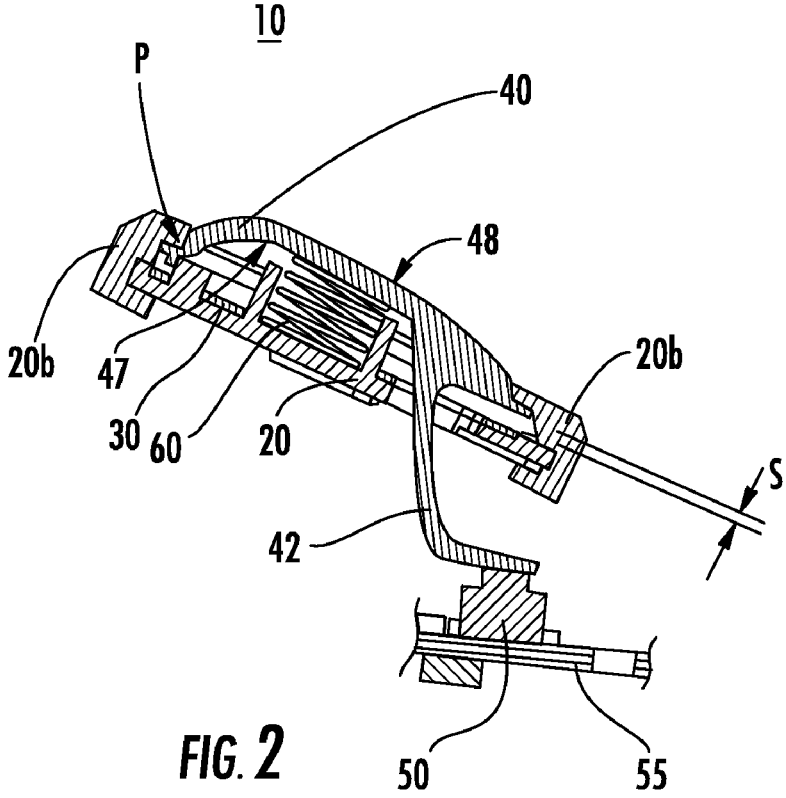
FIG. 2 is another schematic illustration of a cross-sectional view of the button actuation assembly of FIG. 1.
Figure 3:
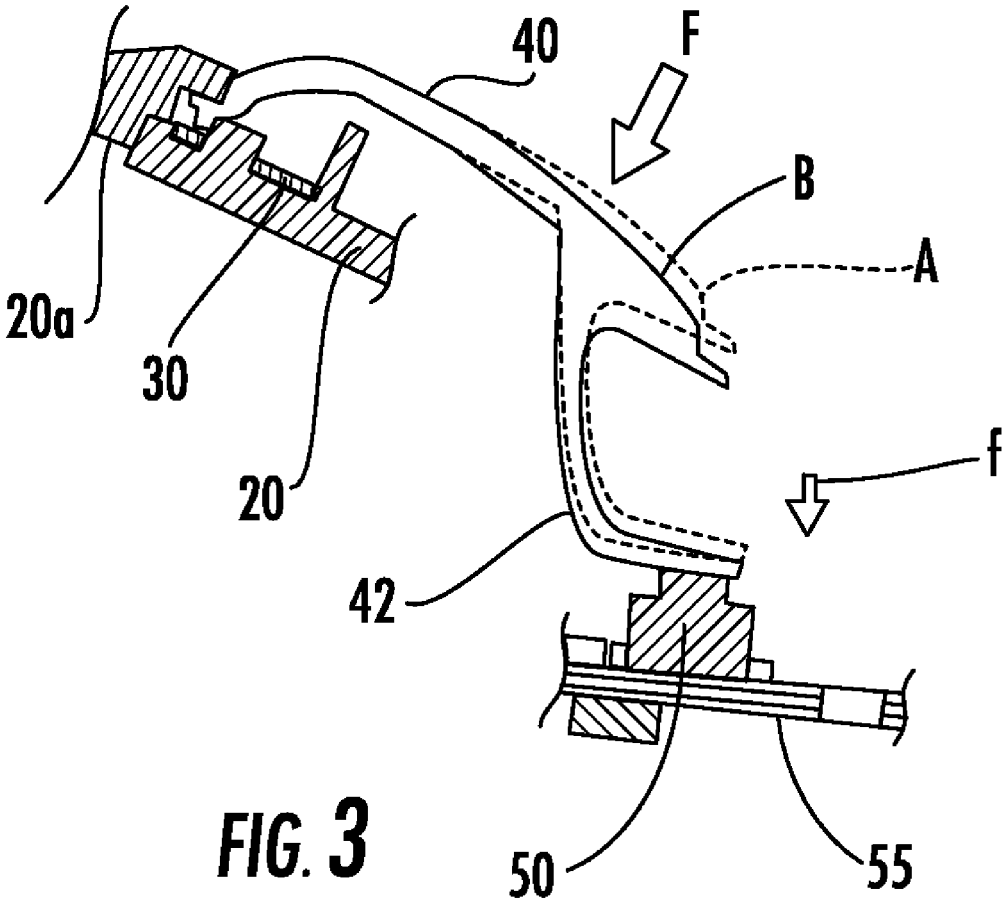
FIG. 3 is a detailed schematic illustration of the cross-sectional view of the button actuation assembly of FIGS. 1 and 2.

Referring to FIGS. 1-3, a button actuation assembly 10 for activating a switch 50 according to an embodiment is described. The button actuation assembly 10 includes a button 40 having an interior side 47 and an exterior side 48. A flexible cantilever 42 is provided on the interior side of the button for engaging the switch 50. The flexible cantilever 42 is in contact with the switch 50 substantially at all times. When a user presses the button 40 by exerting an incident force F on the exterior side 48 of the button, the flexible cantilever 42 is urged against the switch 50 and transfers the force to the switch and activates the switch 50. However, because the flexible cantilever 42 bends, and because point P is a fulcrum or pivot point for the button 40, the transferred force f at the switch 50 is attenuated, i.e. transferred force f is less than the incident force F. The at-rest position A (shown in dotted lines) and the pressed-down position B of the button 40 are shown in FIG. 3. This attenuating function of the flexible cantilever 42 coupled with both the limiting features of the buffer and the force limiting feature of the flexible cantilever 42 protects the switch 50 from being damaged when an excessive force is applied to the button.

A button retainer 20 holds the button 40, at rest, in a fixed position with respect to the switch 50 so that when the button is pressed, it actuates the switch in a repeatable and consistent manner. A bias spring 60 is provided between the button retainer 20 and the button 40 for biasing the button away from the switch 50. The bias spring 60 may be replaced by another equivalent structure such as a block of a compressible elastomeric material or a molded plastic spring element. A button buffer 30 made of a compressible material is provided between the button 40 and the button retainer 20 to evenly distribute and transfer excessive force applied to button 40 to button retainer 20.

The button retainer 20 is configured to retain the button 40 and the button buffer 30 in combination with the button retainer 20 itself as an assembly maintaining the button 40 in a desired position with respect to the switch 50 and to ultimately limit the travel of the button 40 when pressed. This may be achieved in a number of ways. For example, the button retainer 20 can be attached to another structure 20*a* while sandwiching the button 40 and the button buffer 30 between the button retainer 20 and the structure 20*a*. In order to maintain the fixed position of the button 40 with respect to the switch 50, the structure 20*a* should be a structure that also has a fixed position with respect to the switch 50. An example for such structure 20*a* would be a housing for a device within which the switch 50 is provided and the button actuation assembly 10 is incorporated.

Another example is a button actuation assembly in which the button retainer 20 retains the button 40 and the button buffer 30 all within itself by utilizing a structure such as a retaining ring 20*b* as shown in the cross-sectional view in FIG. 2. This embodiment allows the button actuation assembly to be a standalone assembled unit that can be utilized in any appropriate device.

Figure 5:
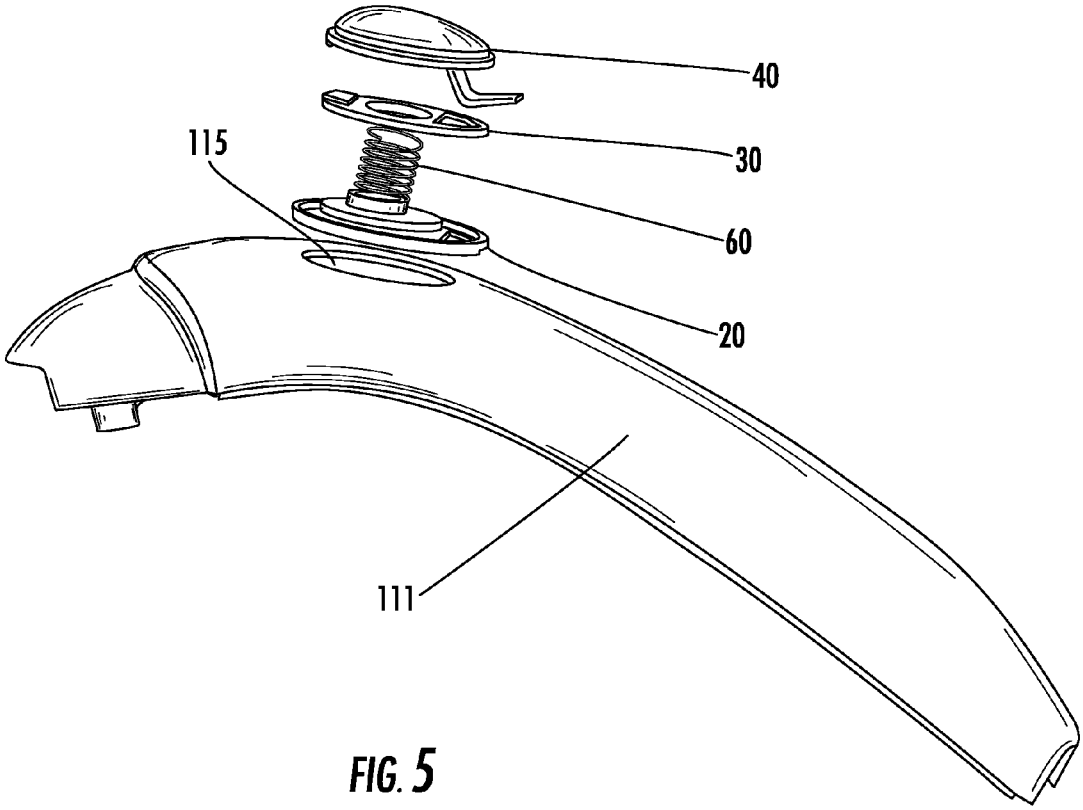
FIG. 5 is a schematic illustration of a partially exploded view of a button actuation assembly implemented in a hand held device according to another embodiment of the invention.

In both examples, the button 40, at rest position, is urged away from the switch 50 and against the perimeter rim 117 of the window 115, as shown in FIG. 5, by the bias spring 60. The button retainer 20 and the button buffer 30 are dimensioned to maintain a space S between the button 40 and the button buffer 30 so that when a user presses the button 40, the gap S is closed and the button 40 contacts the button buffer 30. In the examples illustrated in FIGS. 1-3, the button 40 and the button buffer 30 are held snuggly between the perimeter rim 117 of the window 115 and the button retainer 20 at the point P opposite the flexible cantilever 42, thus forming a pivot point for the button 40 at the point P. Thus, when a user presses on the button 40, the button will pivot at the pivot point P and the end near the flexible cantilever 42 closes the space S and causes the flexible cantilever 42 to press down on the switch 50.

Although the examples illustrated are configured to cause the button 40 to pivot about the point P when pressed, in another embodiment, the assembly may be configured so that the button does not pivot. The button may simply float on the bias spring 60 urged against the perimeter rim 117 maintaining a space between the button 40 and the button buffer 30 all around the perimeter of the button 40. In this embodiment, when the button is pressed, the whole button will move towards the button buffer 30 closing the space S therebetween.

Whether the button 40 pivots or not, when the button contacts the button buffer 30 and is pressed against it the button buffer 30 is compressed and functions to transfer and evenly distribute a portion of the force exerted on the button to button retainer 20. A portion of the force F applied to button 40 is absorbed by the flexible cantilever 42 of the button and this remaining force f is transmitted to the switch. The transmitted force f is sufficient to activate the switch 50. Thus, the flexible cantilever 42 and the button buffer 30 in combination attenuates and limits the force F exerted on the button 40 and function to protect the switch 50 and the button actuation assembly 10 from being damaged by excessive force.

The button buffer 30 also functions to limit the travel of the button when pressed. This is particularly beneficial to protect the assembly from damage when an excessive force is applied to the button. A bias spring is also provided between the button retainer and the button for biasing the button away from the switch.

Figure 4:
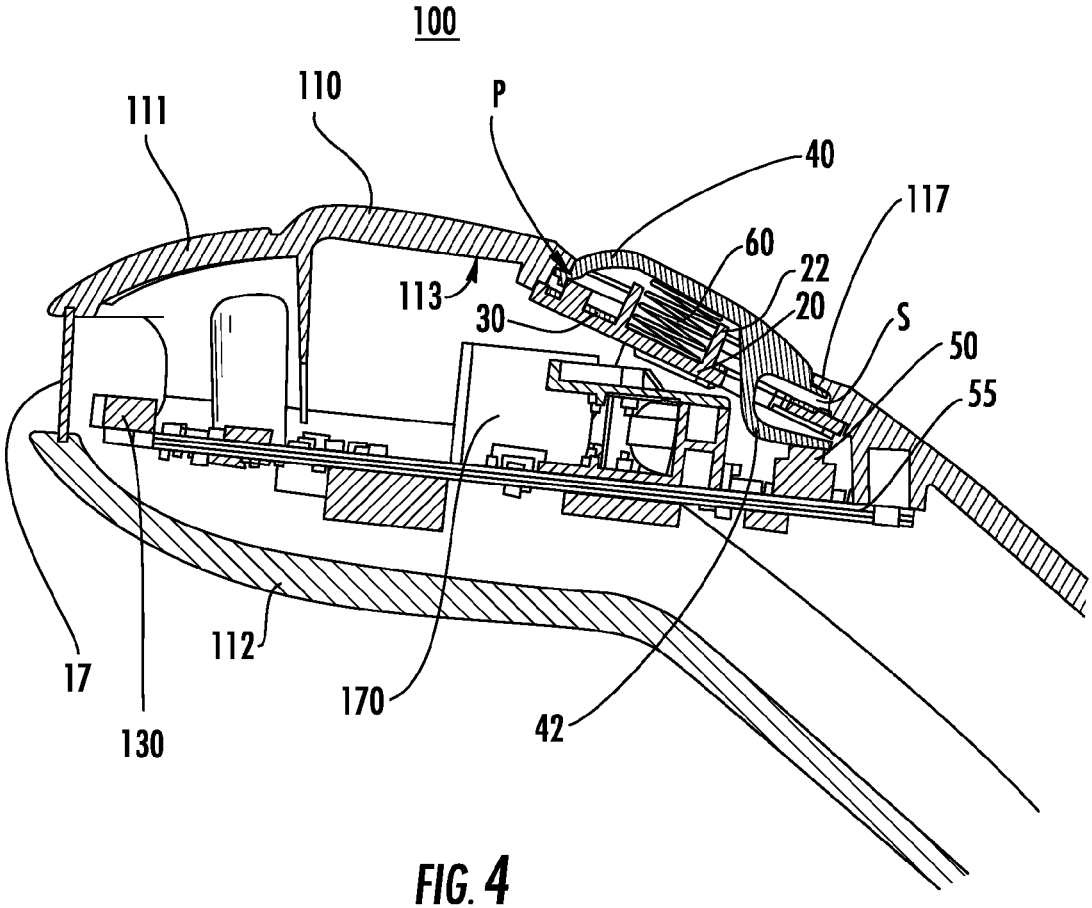
FIG. 4 is a schematic illustration of a cross-sectional view of a hand held device according to another embodiment of the invention.

Referring to FIGS. 4 and 5, a hand held device 100 that incorporates an improved switch activating button is disclosed. Such a device includes a housing 110, a switch 50 provided within the housing for activating a function of the device. The switch 50 is generally provided on a printed circuit board 55 inside the housing 110. The housing 110 can be made of any suitable material, such as a plastic, a metal alloy, or a composite. The device 100 may have one or more printed circuit boards for the various components and wiring necessary for the hand held device's function.

A button 40 having a flexible cantilever 42 engages the switch 50 via the flexible cantilever. A button retainer 20, attached to the interior-side 113 of the housing 110, holds the button 40, at rest, in a fixed position with respect to the switch 50.

The button 40 is exposed through a window 115 in the housing. The button retainer 20 is provided with a receptacle 22 for holding a bias spring 60 that is normally compressed against the underside of the button 40 urging the button upward. The bias spring 60 normally keeps the pressure off of the switch 50. The bias spring 60 shown in this example maybe substituted by other spring-like component such as a block of elastic polymer material. When a user presses the button 40 down, the downward force is transmitted through the flexible cantilever 42 to the switch 50 and activates or deactivates the switch depending on the type of switch used.

The flexible cantilever 42 is a cantilevered beam that presses on the switch 50 when the button is pushed. In normal use, when the button is pushed, the flexible cantilever 42 pushes on the switch 50 with a force determined by the flexible cantilever's spring constant and its physical dimensions (i.e. its thickness and length) enough to activate the switch 50 but not hard enough to damage the switch no matter how hard the button is pressed.

Similarly, when the button 40 is impacted against something, such as when the hand held device is dropped, the cantilever beam action of the flexible cantilever 42 protects the switch 50 from physical damage because the flexible cantilever 42 will attenuate and limit the impact force that is transmitted to the switch 50.

The spring constant of the flexible cantilever 42 is a function of the particular material and its dimensions (i.e. its thickness, for example) and one of ordinary skill in the art would be able to select an appropriate material and the dimensions required for a particular application requirement. A plastic such as acetal, for example, may be used for the button 40 and its flexible cantilever 42.

A button buffer 30 made of a compressible elastomer is provided between the button and the button retainer as a shock absorbing layer and to limit the travel of the button 40 when being pressed. The button buffer 30 absorbs at least a portion of any impact shock transmitting through the button to the button retainer 20 and prevents possible damages to the button retainer. The button buffer 30 may be made of a compressible elastomer. Some examples of such elastomers are thermoplastic vulcanizates, ethylene propylene diene monomer (EPDM) rubber compounds, and polychloroprene rubber compounds. The button buffer 30 also works in concert with the flexible cantilever 42 of the button to limit the overall movement of the button and thus attenuate the impact force transmitted to the switch 50. When a user presses the button, exerting a force on the button, the flexible cantilever attenuates and transfers the force to the switch and activates the switch. Furthermore, the elasticity and compliance of the button buffer provides a softer forgiving feel to the button when the user pushes the button which provides generally more desirable feel to the button.

Because the button retainer 20 is the stationary structure against which the button 40 is pressed, the button retainer 20 is preferably rigidly fixed in position with respect to the housing 110. This may be achieved in a number of ways. In the example illustrated in FIG. 4, the button retainer 20 is affixed to the housing 110 sandwiching the button buffer 30, the bias spring 60 and the button 40 between the button retainer 20 and the interior-side 113 of the housing 110. As discussed above, the bias spring 60 may be substituted readily by another equivalent structure such as a block of a compressible elastomer. The button 40 is exposed through and may even be protruding through the window 115 of the housing 10 but the size of the window 115 opening is smaller than the button 40 so that the perimeter rim 117 of the window 115 retains the button 40 between the housing and the button retainer 20.

Figure 6:
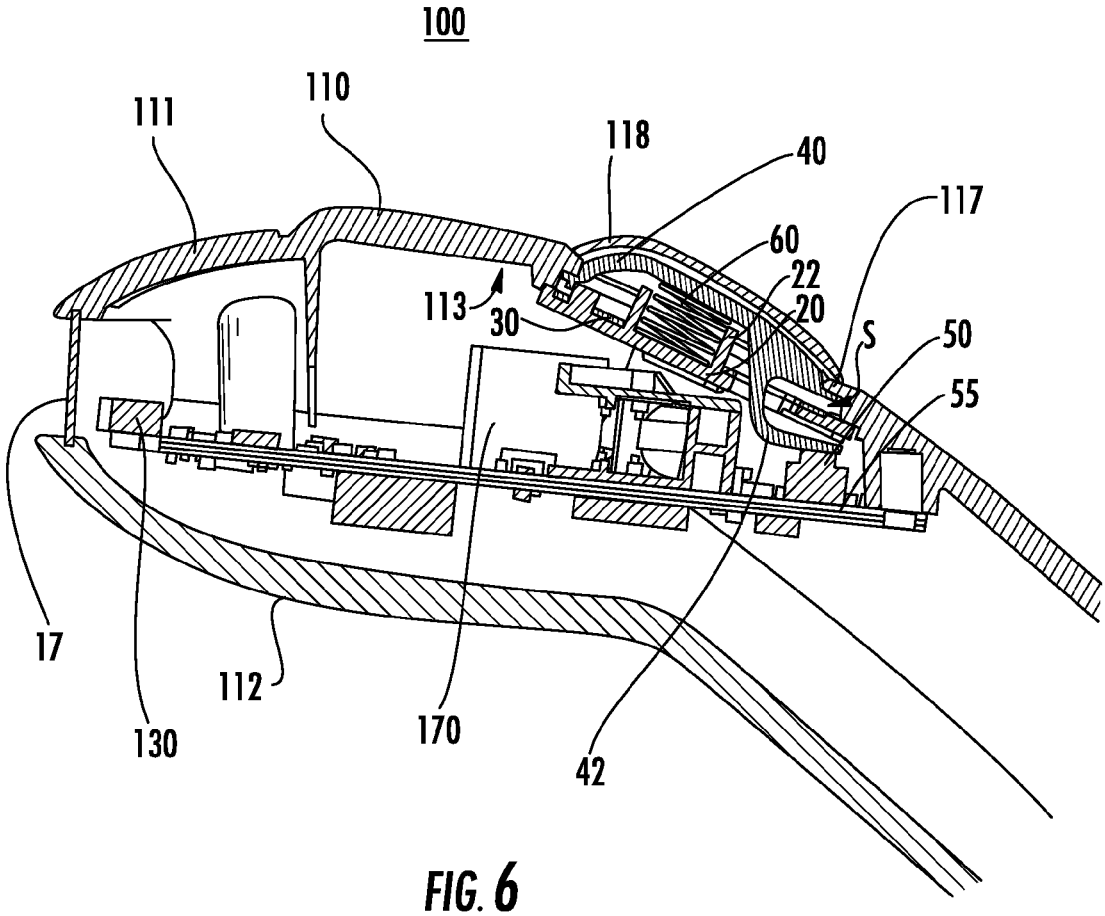
FIG. 6 is a schematic illustration of a cross-sectional view of a hand held device according to another embodiment of the invention.

The window 115 in the housing 110 can be simply an opening through which the button is exposed and the user can press the button as shown in FIGS. 4 and 5. Alternatively, as shown in FIG. 6, to provide better protection to the internal components of the hand held device from such unwanted outside elements as water and dust, for example, the window 115 may be covered with a flexible membrane 118. The membrane is flexible so the button can be pressed through it. Such flexible membrane 118 can either be adhesively or mechanically attached to the housing 110 or integrally molded with the housing 110. A mechanical attachment could be achieved, for example, by a tongue-and-groove type of engagement between the perimeter rim 117 of the window 115 and the flexible membrane 118, by ultrasonically bonding the flexible membrane along the perimeter rim 117, or combination of both or also in combination with an adhesive. Of course, the ultrasonic bonding would only work in an embodiment where the housing 110 is made of a plastic. Such flexible membrane 118 will prevent water or other liquid from entering through the window and damaging the internal components of the hand held device. Some examples of appropriate materials for the flexible membrane 18 are the polymer materials discussed above for the button buffer 30.

Figure 7A:
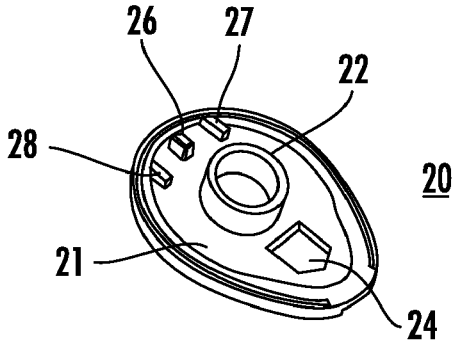
FIGS. 7*a*-7*b* are schematic illustrations of various views of a button retainer according to an embodiment of the invention.
Figure 7B:
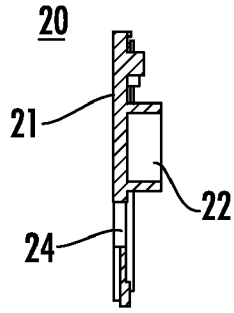

Referring to FIGS. 7*a* and 7*b*, an example of a button retainer 20 is illustrated. The button retainer 20 comprises a base portion 21 that is shaped similar to the outline of the button 40 (shown in FIGS. 9*a*-9*b*). The button retainer 20 has an opening 24 through which the flexible cantilever 42 of the button 40 extends and engages the switch 50. The receptacle 22 on the button retainer 20 holds the bias spring 60 in place between the button retainer and the button 40. A plurality of assembly alignment tabs 26, 27, 28 are also provided on the button retainer 20 for keeping the components of the button switch actuator assembly, the button retainer 20, the button buffer 30, and the button 40 in an alignment.

Figure 8A:
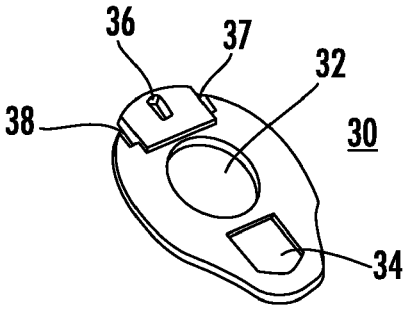
FIGS. 8*a*-8*b* are schematic illustrations of various views of a button buffer according to an embodiment of the invention.
Figure 8B:
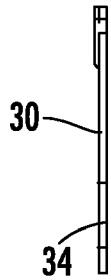

Referring to FIGS. 8*a* and 8*b*, an example of a button buffer 30 is illustrated. The button buffer 30 is shaped to have a shape substantially similar to the outline of the button 40 (shown in FIGS. 9*a*-9*b*) so that when the button 40 is pressed, other than the flexible cantilever 42 which contacts the switch 50, the body of the button 40 comes down on to and only contacts the button buffer 30. Because the button buffer 30 is made of a compressible elastomer, when the button 40 is impacted against a hard surface, such as when the hand held device 100 is dropped, the button buffer 30 cushions and limits the travel of the button 40 and absorbs a portion of the impact shock (the remaining portion of the impact shock being absorbed by the flexible cantilever 42 as it flexes against the switch 50). The button buffer 30 has a first opening 34 corresponding to the opening 24 of the button retainer through which the flexible cantilever 42 of the button extends. The button buffer 30 also has a second opening 32 through which the receptacle 22 of the button retainer 20 fits when the three components of the button switch actuator assembly is assembled. The button buffer 30 is provided with a plurality of alignment holes 36, 37, 38 that mates with the corresponding alignment tabs 26, 27, 28, respectively, for keeping the button buffer 30 aligned with the button retainer 20.

Figure 9A:
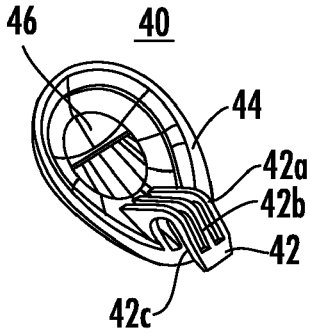
FIGS. 9*a*-9*b* are schematic illustrations of various views of a button according to an embodiment of the invention.
Figure 9B:
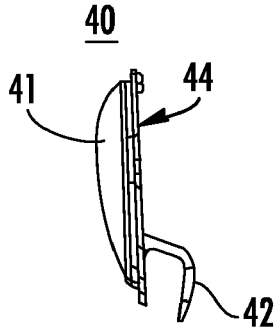

Referring to FIGS. 9*a* and 9*b*, an example of a button 40 is illustrated. The button 40 comprises a main portion 41 and a flexible cantilever 42. As discussed above, the flexible cantilever 42 engages the switch 50. The main portion 41 of the button has a central portion 46 that is concave as viewed from the underside of the button 40 for receiving the bias spring 60. The main portion 41 also has a rim 44 that has the outline matching those of the button retainer 20 and the button buffer 30. The rim 44 contacts the button buffer 30 when the button 40 is fully pressed.

The flexible cantilever 42, in this example is formed integrally with the body of the button 40 for engaging the switch 50. The particular dimensions of the flexible cantilever 42 is determined by the particular material selected for the button 40 and the particular spring constant desired for a particular application. For example, for a given material, the flexible cantilever 42 maybe made to be thinner to reduce the spring constant and made to be thicker to increase the spring constant. The particular spring constant required would be determined by the force required to actuate the particular switch 50.

The flexible cantilever 42 illustrated in FIG. 9*a* is structured to have three legs 42*a*, 42*b*, 42*c*, rather than being formed as a single solid structure. This is just another example of how the spring constant of the flexible cantilever 42 can be controlled by varying the number and size of the legs.

Referring back to the cross-sectional view of the button switch actuator assembly shown in FIG. 4, it should be noted that in the fully assembled state, button 40 and the button buffer 30 are held snuggly between the perimeter rim 117 of the window 115 and the button retainer 20 at the point P opposite the flexible cantilever 42, thus forming a pivot point for the button 40 at the point P. As shown, the button 40 is normally urged against the perimeter rim 117 of the window 115 by the bias spring 60 but away from the pivot point P, there is a space S between the button 40 and the button buffer 30. Thus, when a user presses on the button 40, the button will pivot at the pivot point P and the end near the flexible cantilever 42 gets pushed in closing the space S and bending the flexible cantilever 42.

As shown in FIGS. 4 and 5, the housing 110 maybe a two-piece housing comprising an upper piece 111 and a lower piece 112 where the button retainer 20 is attached to the interior-side 113 of the upper piece 111 and holds the button 40 between the button retainer and the upper piece of the housing. FIG. 5 is an exploded view of the button switch actuator assembly shown with only the upper piece 111 of the housing 110. Alternatively, the button retainer 20 can be attached to the lower piece of the housing.

Figure 10:
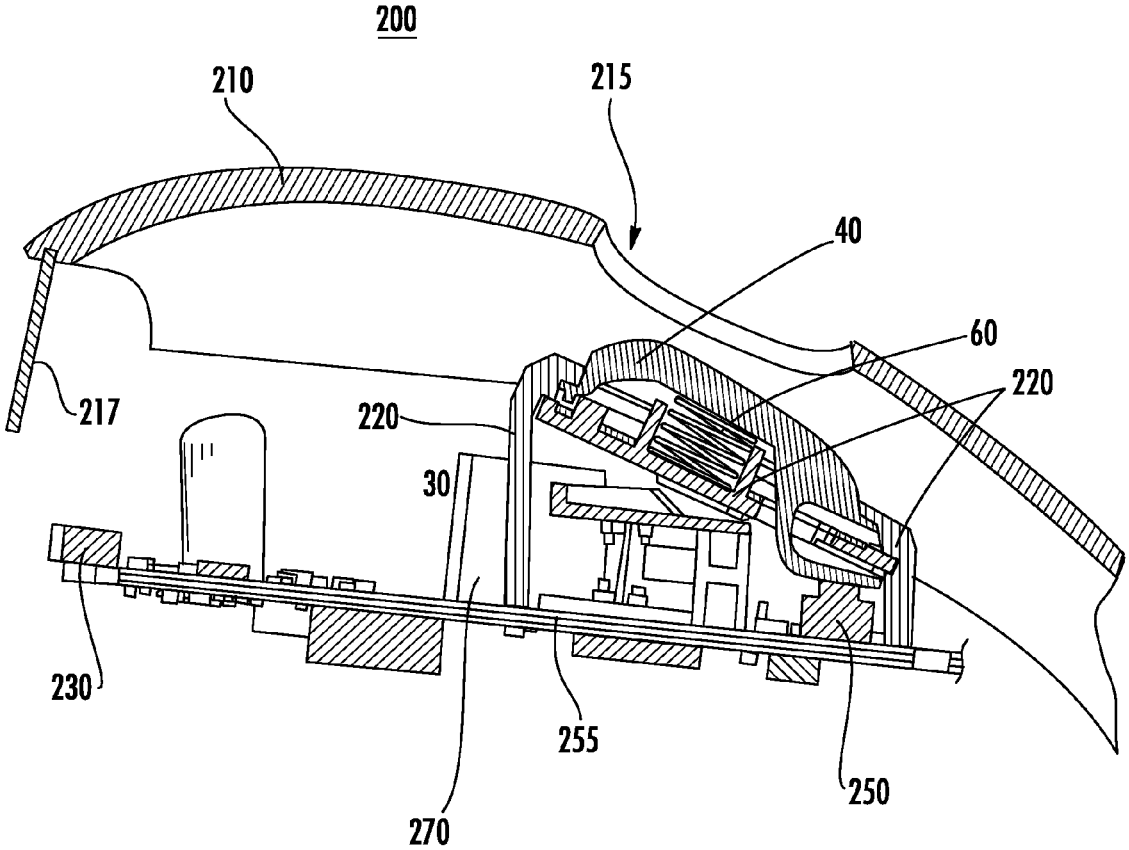
FIG. 10 is a schematic illustration of a partially exploded cross-sectional view of a hand held barcode reading device according to another embodiment of the invention.
Figure 11:
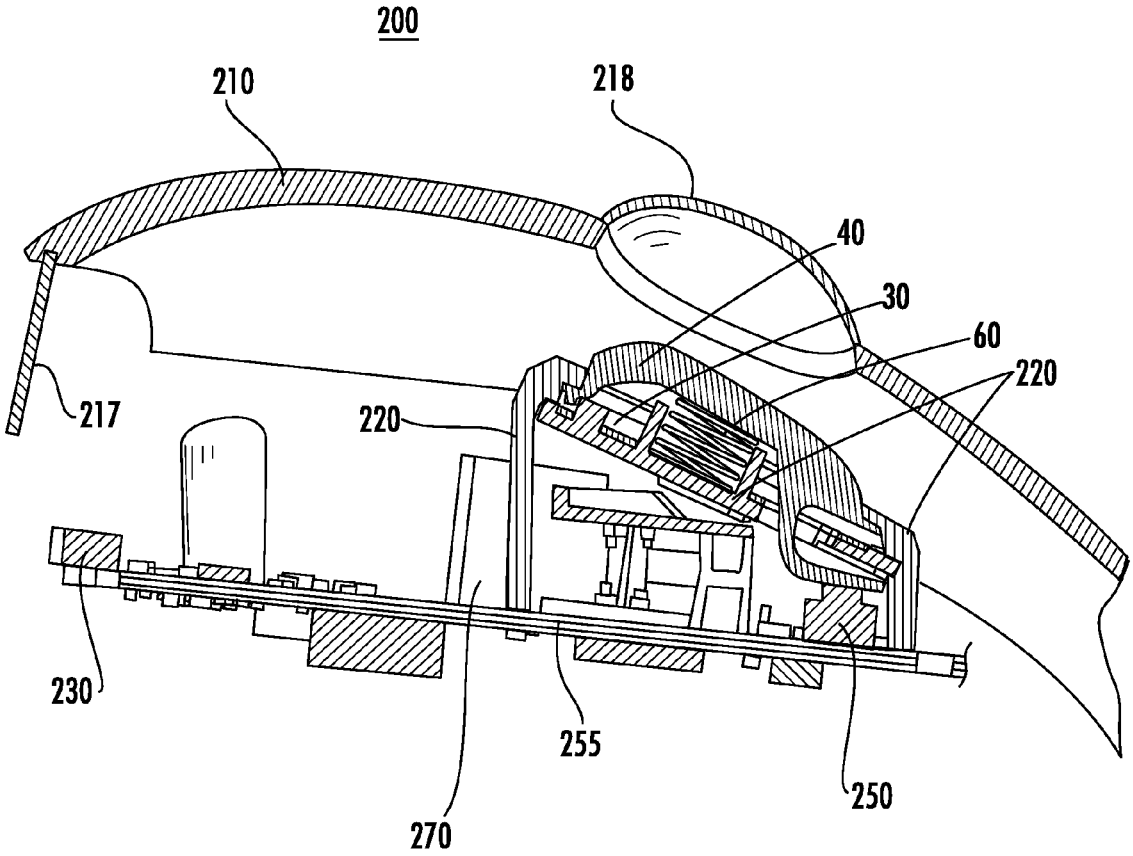
FIG. 11 is a schematic illustration of a partially exploded cross-sectional view of a variation on the hand held barcode reading device of FIG. 10.

Referring to FIG. 10, a partially exploded cross-sectional view of a hand held device 200 according to another embodiment is illustrated. In this embodiment, the button retainer 220 is affixed to the printed circuit board 255 on which the switch 250 is provided. Here the button retainer 220 is configured to hold the button buffer 30, the button 40 and the bias spring 60 within the button retainer 220 itself. Thus, the assembled printed circuit board 355 includes the fully functioning switch 250 and the button switch actuating assembly, the button switch actuating assembly comprising the button retainer 220, the button buffer 30, and the button 40. When the printed circuit board 255 is assembled with the housing 210, the button 40 aligns with the window 215 provided on the housing 210 presenting the button 40 to the user through the window 215. The window 215 maybe an opening or the window 215 may be covered with a flexible membrane 218 as shown in FIG. 11. Some examples of appropriate materials for the flexible membrane 218 are the polymer materials discussed above for the button buffer 30. The flexible membrane 218 may be attached to the housing 210 by the same methods discussed above in reference to the flexible membrane 18 and the housing 10 of the hand held device 100.

The hand held devices 100 and 200 of FIGS. 4, 6, 10, and 11 may be any type of electronic or electromechanical device in which the button 40 is used to activate the switch 50 for enabling a function of the devices. However, the particular examples in which the inventors have implemented the improved button switch activator is a hand held barcode reader. Thus, the hand held devices 100 and 200 of FIGS. 4, 6, 10, and 11 are illustrated as examples of a such barcode reader. On the printed circuit boards 55, 255 are laser beam sources 170, 270, respectively. When the switches 50, 250 are activated by pressing the buttons 40, the laser beam sources 170, 270 produces laser beams that propagates through the laser scanning windows 17, 217 and are used to scan barcodes. Photodiodes 130, 230 measure the intensity of the reflected laser beam for decoding the barcode. In use, the user would point the laser scanning windows 17, 217 at a barcode and press the button 40.

Figure 12:
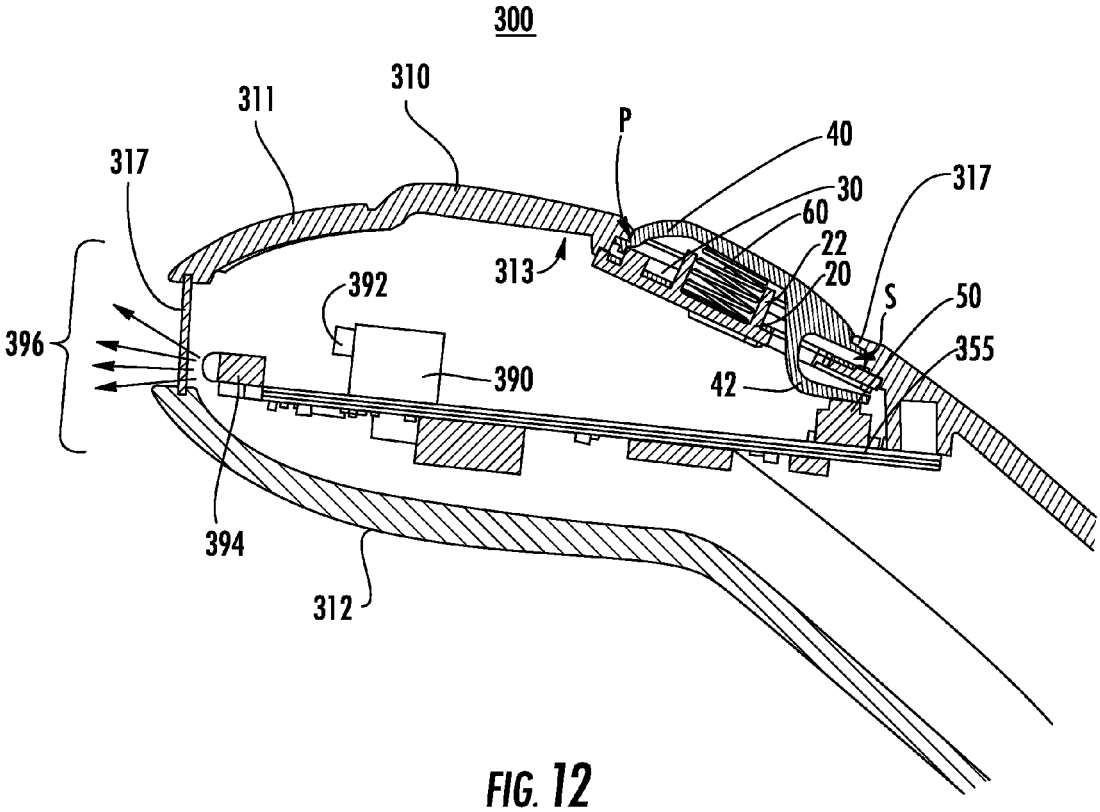
FIG. 12 is a schematic illustration of another embodiment of the invention.

Referring to FIG. 12, a cross-sectional schematic illustration of an embodiment wherein the improved button actuation assembly of the present invention is employed in a camera-based barcode reader 300 is shown. The camera-based barcode reader 300 includes a housing 310, a switch 50 provided within the housing for activating a light source 394 for illuminating the barcode. The switch 50 is generally provided on a printed circuit board 355 inside the housing 310. The barcode reader 300 may have one or more printed circuit boards for the various components and wiring necessary for the barcode reader's function. The housing 310 maybe a two-piece housing comprising an upper piece 311 and a lower piece 312 where the button retainer 20 is attached to the interior-side 313 of the upper piece 311 and holds the button 40 between the button retainer and the upper piece of the housing.

As in the previous embodiments, the button 40 engages the switch 50 via the flexible cantilever 42. The button retainer 20, attached to the interior-side 313 of the housing 310, holds the button 40, at rest, in a fixed position with respect to the switch 50. The button 40 is exposed through a window in the housing. The bias spring 60 normally compressed against the underside of the button 40 and urging the button upward is provided within the receptacle 22 of the button retainer 20. When a user presses the button 40, the downward force is transmitted through the flexible cantilever 42 to the switch 50 and activates or deactivates the switch depending on the type of switch used.

The camera-based barcode reader 300 is provided with the light source 394 for illuminating the barcode and a camera module 390 for capturing the image of the illuminated barcode. The camera module 390 can be a solid state device such as a CCD and may be provided with a lens 392 to help focus on the barcode. The divergent light rays 396 from the light source 394 propagating through the window 317 is graphically illustrated.

While the foregoing invention has been described with reference to the above embodiments, various modifications and changes can be made without departing from the spirit of the invention. Accordingly, all such modifications and changes are considered to be within the scope of the appended claims.

What is claimed is:

1. A button actuation assembly for activating a switch comprising:

a button having an interior side and an exterior side;

a flexible cantilever provided on the interior side of the button for engaging the switch, wherein when the button is pressed by a force exerted on the exterior side of the button the flexible cantilever attenuates and transfers the force to the switch activating the switch;

a button retainer holding the button, at rest, in a fixed position with respect to the switch; and a compressible button buffer provided between the button and the button retainer.

2. The assembly of claim 1, further comprising a biasing spring provided between the button retainer and the button for biasing the button away from the switch.

* * * * *